US008852712B1

(12) United States Patent
Diaz

(10) Patent No.: US 8,852,712 B1
(45) Date of Patent: Oct. 7, 2014

(54) EXERCISE EQUIPMENT PROTECTIVE COVERING SYSTEM AND METHOD

(76) Inventor: Amber Diaz, Miramar, FL (US)

( * ) Notice: Subject to any disclaimer, the term of this patent is extended or adjusted under 35 U.S.C. 154(b) by 421 days.

(21) Appl. No.: 13/207,902

(22) Filed: Aug. 11, 2011

Related U.S. Application Data

(60) Provisional application No. 61/372,664, filed on Aug. 11, 2010.

(51) Int. Cl.

| | |
|---|---|
| ***B32B 5/00*** | (2006.01) |
| ***B32B 7/00*** | (2006.01) |
| ***B23B 3/06*** | (2006.01) |

(52) U.S. Cl.
USPC ..... 428/100; 428/99

(58) Field of Classification Search
USPC ..... 428/100, 99
See application file for complete search history.

(56) References Cited

U.S. PATENT DOCUMENTS

2005/0264056 A1* 12/2005 Hanberg ..... 297/219.12

* cited by examiner

*Primary Examiner* — Brent O'Hern

(57) ABSTRACT

An exercise equipment protective covering system and method is disclosed which generally comprises a front surface having an upper portion and a lower portion. A back surface is coupled to the upper portion of the front surface such that a retention pocket is formed there between. A pair of retention straps are coupled to the lower portion of the front surface and used to secure the protective covering to an exercise training bench. The front surface may include a graphical indicia thereon. Also, an accessory pocket is coupled to the protective covering for the storage of personal items.

12 Claims, 1 Drawing Sheet

EXERCISE EQUIPMENT PROTECTIVE COVERING SYSTEM AND METHOD

CROSS-REFERENCE TO RELATED APPLICATIONS

This Non-Provisional Utility Patent Application claims priority to U.S. Provisional Patent Application Ser. No. 61/372,664 filed on Aug. 11, 2010, which is incorporated herein in its entirety.

FIELD OF THE INVENTION

The present invention relates generally to a system and method for covering exercise equipment prior to and/or during use to prevent a user from contact with bodily fluids from other users which may be present on the surfaces of the exercise equipment. The invention is, however, more particularly directed to an exercise equipment cover that a user may easily install and remove from a training bench during a workout regimen.

BACKGROUND OF THE INVENTION

At present, it is well-known the importance of exercising for keeping a healthy body. Practicing sports of any type has become very popular for people of all ages, from kids to elders. Exercise benefits many parts of the body, including the mind. Exercising causes the body to produce endorphins, chemicals that can help a person to feel more peaceful and happy. Exercise can help some people sleep better. Exercise can also help some people who have mild depression and low self-esteem. People who exercise burn more calories and look more toned than those who do not. In fact, exercise is one of the most important parts of keeping your body at a healthy weight.

However, practicing regular sports like football or baseball is difficult for adults because of their daily schedule and the distance to the fields. That is one reason why going to health clubs (commonly referred to as a "gym") is an excellent choice and extremely popular in today's society. Health clubs are usually open all day long, and they offer a wide array of services, including: a) a workout area, which primarily consists of free weights, including dumbbells, barbells and exercise machines; b) a cardio area, including many types of cardiovascular training-related equipment such as rowing machines, stationary exercise bikes, elliptical trainers and treadmills; c) sports facilities such as swimming pools, squash courts or boxing areas.

One of the typical pieces of equipment usually included as part of the workout area is the weight training bench. It is a piece of equipment that has a resemblance to a normal bench, but is designed for use in weight training. Weight training benches may be of various designs: fixed horizontal, fixed inclined, fixed in a folded position, with one adjustable portion, with two or more adjustable portions, with racks to hold bars, etc.

Benches are not only used for weight training, but also for many exercises like seated presses, crunches, etc. Every time a user is using the bench, perspiration remains on the outer surface of the bench in contact with the body. Even though some users are considerate enough to clean up the surface with a towel after the exercise, many users make no attempt to clean the surface for the next user. Failure to clean such surfaces is particularly common in crowded gyms, where one user might begin to use a piece of exercise equipment a mere few minutes or even seconds after a previous user completed use thereof. With such a short time interval between users, a great possibility exists for disease, bacteria and virus transmission. In addition to this likelihood, most people simply find it unpleasant to sit, lay, or grasp exercise equipment, which is coated in sweat from another person. For these reasons, many gyms at least attempt to require that each person wipe down the equipment after they use it.

There are some protective systems known in the market for covering a piece of training equipment. For example, an exercise equipment covering method for use by a person when using exercise equipment having a handle bar, comprising the steps of: providing a cover which is tubular, having two open ends and a longitudinal zipper extending between the two open ends, opening the longitudinal zipper to create a rectangular sheet of the cover, wrapping the cover around the handle bar; closing the zipper to form the cover into a tube through which the handle bar extends; using the exercise equipment; and removing said cover by the person. While this known solution is somewhat useful it presents some drawbacks. The zippered covering of the exercise equipment handle/bar is usually installed by the health club and remains on the equipment for an extended period of time. This in turn, actually produces an environment that is conducive for retaining bacteria, germs and viruses if not frequently removed and sanitized. Another disadvantage is that this solution does not cover a surface of a training bench and therefore leaves the bench surface free to accumulate sweat, bacteria and germs from other users.

Efforts to provide an exercise equipment protective covering for selectively covering exercise equipment training benches prior to and during use, to prevent the user from contact with bodily fluids from others that overcomes the drawbacks in the prior art have not met with significant success to date. As a result, there is a need in the art for a simple and affordable exercise equipment protective covering that provides for convenient application to a training bench.

SUMMARY OF THE INVENTION

The basic inventive concept provides an exercise equipment covering system to produce a protective system which prevents the transmission of diseases, bacteria, germs, viruses and other bodily fluids between people who use the same piece of exercise equipment.

From an apparatus aspect, the invention comprises an exercise equipment protective cover for providing a barrier between a user and a surface of a piece of exercise equipment is disclosed. The protective cover includes a front surface having an upper portion and a lower portion. There is at least one retention strap having a first end and an opposite second end where the first end of the retention strap coupled to the lower portion of the front surface. A back surface is coupled to the upper portion of the front surface such that a perimeter seam is formed between the front surface and the back surface. There is a retention pocket formed between the front surface and the back surface.

From a system aspect, the invention comprises an exercise equipment protective covering system for providing a barrier between a user and a surface of a piece of exercise equipment is disclosed. The protective cover includes a front surface having an upper portion and a lower portion. There is at least one retention strap having a first end and an opposite second end where the first end of the retention strap coupled to the lower portion of the front surface. A back surface is coupled to the upper portion of the front surface such that a perimeter seam is formed between the front surface and the back surface. There is a retention pocket formed between the front surface and the back surface.

From a method aspect, the invention comprises a method of fabricating an exercise equipment protective cover comprising the steps of: a) providing a front surface including an upper portion and a lower portion; b) coupling a back surface to the upper portion of the front surface such that a perimeter seam is formed between the front surface and the back surface: c) providing at least one retention strap having a first end and an opposite second end; and d) coupling the first end of the at least one retention strap to the lower portion of the front surface.

For a fuller understanding of the nature and advantages of the present invention, reference should be made to the ensuing detailed description of the preferred embodiments taken in conjunction with the accompanying drawings.

BRIEF DESCRIPTION OF THE DRAWINGS

The components in the figures are not necessarily to scale, emphasis instead being placed upon illustrating the principles of the invention. The invention will now be described, by way of example, with reference to the accompanying drawings, in which.

In the figures, like reference numerals designate corresponding elements throughout the different views of the drawings.

DETAILED DESCRIPTION OF THE PREFERRED EMBODIMENTS

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. In other implementations, well-known features and methods have not been described in detail so as not to obscure the invention. For purposes of description herein, the terms "upper", "lower", "left", "right", "front", "back", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments which may be disclosed herein are not to be considered as limiting, unless the claims expressly state otherwise.

Figure 1:
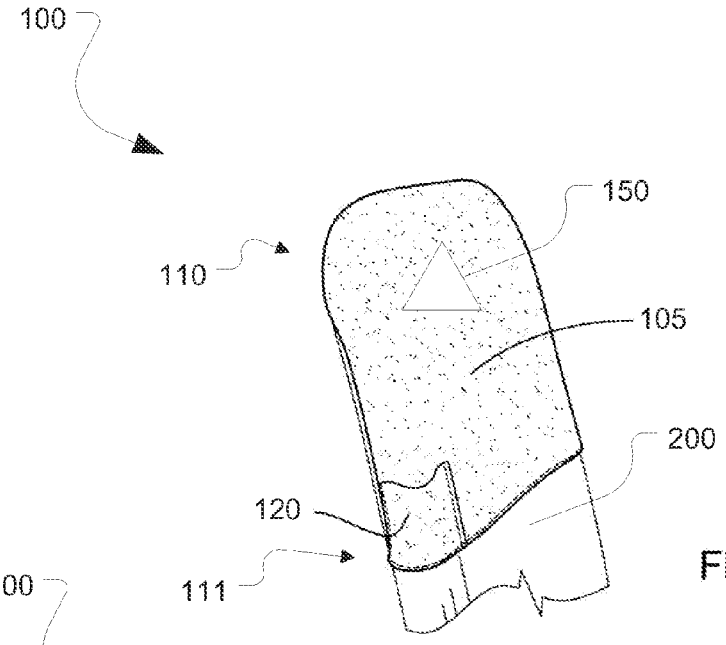
FIG. 1 is a general frontal perspective view of an exercise equipment protective covering system in accordance with the present invention.
Figure 2:
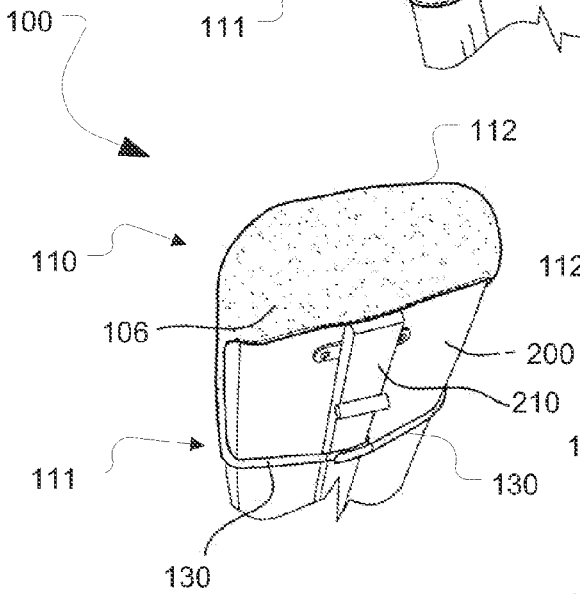
FIG. 2 is a rear perspective view of the present invention showing the back surface of the system and coupled to a training bench in accordance with the present invention.

An exercise equipment protective covering system 100 is illustrated in FIG. 1 and FIG. 2. The exercise equipment protective covering system 100 has a front surface 105, an opposing back surface 105, an upper portion 110, and a lower portion 111. The exercise equipment protective covering system 100 is preferably made from an absorbent fabric such as a terry-cloth material, a micro-fiber cloth or other durable and absorbent material. Additionally, the fabric selected should be washable, reusable and capable of being sanitized to eliminate any germs, bacterial or other contaminants that may contact the exercise equipment protective covering system 100. The front surface 105 of the exercise equipment protective covering system 100 is coupled to the back surface 106 along upper portion 110 and forms a perimeter seam 112 there along. Seam 112 may be formed by sewing the front surface 105 to the back surface 106. In other embodiments, seam 112 may be formed using other textile manufacturing methods such as weaving. These alternative textile manufacturing methods are well known and one of ordinary skill in the art would readily appreciate their application in fabricating the exercise equipment protective covering system 100 of the present invention. exercise equipment protective covering system 100 is sized and configured to fit over an exercise training bench 200 such that front surface 105 extends from an upper end towards a lower end of the training bench 200.

In one exemplary embodiment, an accessory pocket 120 is coupled adjacent to the lower portion 111 of the front surface 105 and laterally biased to either the left or right side of the exercise equipment protective covering system 100. In other exemplary embodiments, there may be more than one accessory pocket 120 coupled to the exercise equipment protective covering system 100 such that a user may temporarily store personal items such as keys, sanitizer, a cellular phone, a music player etc. inside the accessory pocket 120. It is further contemplated that accessory pocket 120 may be coupled to back surface 106 (not shown) as an alternative location for storing personal items.

Figure 3:
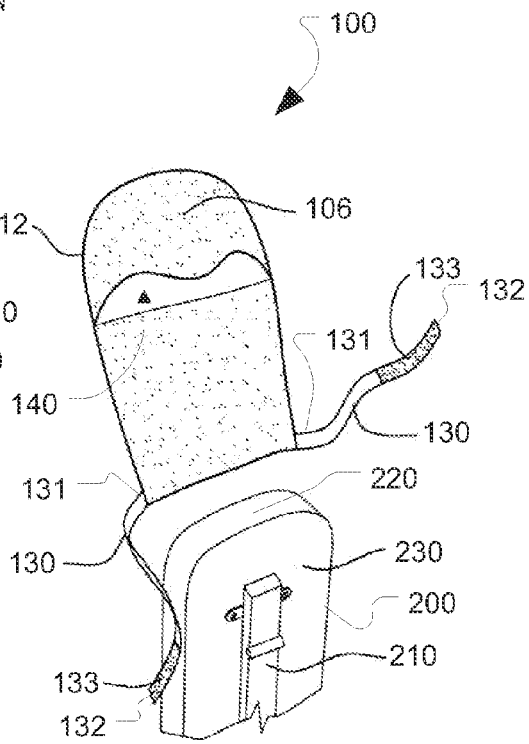
FIG. 3 is rear perspective view of the present invention showing the back surface of the system and an upper pocket of the system for coupling to an upper portion of a training bench in accordance with the present invention.

Directing attention to FIGS. 2 and 3, a pair of retention straps 130 is coupled to the lower portion and provide a means for securing the exercise equipment protective covering system 100. Retention straps 130 are sized and configured to encompass the training bench 200 and secure the lower portion 111 of the exercise equipment protective covering system 100 so that the front surface 105 remains substantially aligned with the exposed surface of the training bench 200. Retention straps 130 may be coupled to the lower portion 111 of the front surface 105 by sewing a first end 131 of retention strap 130 to the front surface. In other embodiments, retention straps 130 may be formed integrally with the front surface 105 using other textile manufacturing methods such as weaving. These alternative textile manufacturing methods are well known and one of ordinary skill in the art would readily appreciate their application in fabricating the exercise equipment protective covering system 100 of the present invention. Retention straps 130 may be secured to each other by coupling the second ends 132 together using corresponding hook and loop fasteners 133. In other exemplary embodiments, the second ends 132 of retention straps 130 may be secured using other fastening means such as buttons, clips, snaps, clasps, or tied in a releasable knot.

In one exemplary embodiment, back surface 106 partially extends from the upper portion 110 towards the lower portion 111 and forms a retention pocket 140 there between. By partially extending the back surface 106, the exercise equipment protective covering system 100 provides clearance for the support bar 210 of the training bench 200 which facilitates installation and removal of the exercise equipment protective covering system 100. In this embodiment, the retention straps 130 extend behind the front surface 105 and are spaced apart from the retention pocket 140 to form an opening between the retention pocket 140 and the retention straps 130. The retention straps 130 secure the front surface 105 lower portion to the training bench 200, providing a secure attachment of the protective covering system 100 to the training bench 200 regardless of the fact that only part of the training bench 200 is inserted in the retention pocket 140. In an alternate embodiment, retention pocket 140 may substantially extend from the upper portion 105 towards the lower portion 106 and in this case, the retention pocket 140 would be sized to fit over the support bar 210 of the training bench 200.

In one exemplary embodiment, the front surface 105 extends substantially the entire length of the training bench 200. Alternatively, the front surface 105 of the exercise equipment protective covering system 100 may only partially extend the length of training bench 200 such as half-way from the upper end towards the lower end of the training bench 200.

In an alternate embodiment, the front surface 105 of the exercise equipment protective covering system 100 may include a graphical indicia 150 coupled thereon and outwardly facing there from. In this alternate embodiment, indicia 150 may be the name of a sports team, a company logo, graphical representation of a team mascot, team logo, school logo, graphical emblem, college logo, text statement or the like. It is contemplated that indicia 150 may be coupled to the front surface 105 of the exercise equipment protective covering system 100 by sewing a patch indicia thereto. It is further contemplated that other textile manufacturing methods may be employed to provide indicia 150 with the exercise equipment protective covering system 100 of the present invention. These alternate textile manufacturing methods may include silk-screening, embroidery, needlepoint, iron-on emblems or the like. These alternative textile manufacturing methods are well known and one of ordinary skill in the art would readily appreciate their application in fabricating the exercise equipment protective covering system 100 to include indicia 150 of the present invention.

In operation, the exercise equipment protective covering system 100 is fitted over a training bench 200 to provide a protective covering that separates the user from the outwardly facing surface of the training bench. As a result, when the user then leans on or makes contact with the training bench, the exercise equipment protective covering system 100 provides a barrier between the surface of the bench and the body of the user. Directing attention to FIGS. 1, 2 and 3, in combination, the exercise equipment protective covering system 100 is initially positioned above the upper end 220 of the training bench 200 such that back surface 106 is aligned with a back surface 230 of the training bench 200. Next, retention pocket 140 is slipped over the upper end 220 of the training bench 200 such that the lower portion 111 of the front surface 105 extends down the surface of the training bench. The exercise equipment protective covering system 100 is then secured to the training bench 200 by the retention straps 130. The retention straps 130 extend from the front surface 105 and wrap around the back of the training bench 200. The free ends of the retention straps 130 are then coupled together using the hook and loop fasteners 133 provided thereon. When the user desires to remove the exercise equipment protective covering system 100 from the training bench 200, the above described method is reversed and the user may take the exercise equipment protective covering system 100 to the next piece of exercise equipment in their training regimen.

As will be now apparent to those skilled in the art, exercise equipment protective covering systems fabricated according to the teachings of the present invention are capable of providing a user with an exercise environment that reduces the potential transmission of disease, germs, bacteria, viruses and other bodily fluids from an exercise bench to the user. Since the present invention permits a user to conveniently cover a portion of a training bench, the present invention provides a barrier between the user and the surface of the bench. Importantly, the present invention provides an exercise equipment protective cover that is compact, easily moved, washable and enjoyable to use.

Although the above provides a full and complete disclosure of the preferred embodiments of the invention, various modifications, combinations, alternate constructions and equivalents will occur to those skilled in the art. For example, although the invention has been described with reference to coupling the lower end of the front surface to the training bench using a pair of retention straps, alternatively the retention strap may be comprised of a single elastomeric strap that stretches around the training bench. In addition, although the front surface and back surface have been described as separate elements other configurations are possible such unitary construction. It is intended that all matters in the foregoing description and shown in the accompanying drawings be interpreted as illustrative and not in a limiting sense. Therefore the above should not be construed as limiting the invention, which is defined by the appended claims and their legal equivalence.

What is claimed is:

1. An exercise equipment protective cover for providing a barrier between a user and a surface of a piece of exercise equipment, comprising:

a front surface including an upper portion and a lower portion;

at least one retention strap having a first end and an opposite second end, said first end of said at least one retention strap coupled to said lower portion of said front surface; and a back surface coupled to said upper portion of said front surface such that a perimeter seam is formed between said front surface and said back surface, wherein a retention pocket is formed between said front surface and said back surface, wherein said back surface extends partially along said front surface from said upper portion towards said lower portion, and wherein said at least one retention strap is configured to extend behind said front surface, in a spaced-apart configuration from said retention pocket to form an opening therebetween, and is configured to secure said front surface lower portion to a piece of exercise equipment when said piece of exercise equipment is partially inserted in said retention pocket.

2. An exercise equipment protective cover as recited in claim 1, wherein said front surface is fabricated from an absorbent material.

3. An exercise equipment protective cover as recited in claim 1, further comprising at least one graphical indicia coupled to said front surface.

4. An exercise equipment protective cover as recited in claim 1, wherein said at least one retention strap comprises a fastener coupled to said second end.

5. An exercise equipment protective cover as recited in claim 4, wherein said fastener is a hook and loop fastener.

6. An exercise equipment protective cover as recited in claim 1, further comprising at least one accessory pocket coupled to said exercise equipment protective cover, wherein said at least one accessory pocket provides an outwardly accessible storage region for personal items.

7. An exercise equipment protective covering system for providing a barrier between a user and a surface of a piece of exercise equipment, comprising:

a front surface including an upper portion and a lower portion;

at least one retention strap having a first end and an opposite second end, said first end of said at least one retention strap coupled to said lower portion of said front surface; and a back surface coupled to said upper portion of said front surface such that a perimeter seam is formed between said front surface and said back surface, wherein a retention pocket is formed between said front surface and said back surface, wherein said back surface extends partially along said front surface from said upper portion towards said lower portion, and wherein said at least one retention strap is configured to extend behind said front surface, in a spaced-apart configuration from said retention pocket to form an opening therebetween, and is configured to secure said front surface lower portion to a piece of exercise equipment when said piece of exercise equipment is partially inserted in said retention pocket.

8. An exercise equipment protective covering system as recited in claim 7, wherein said front surface is fabricated from an absorbent material.

9. An exercise equipment protective covering system as recited in claim 7, further comprising at least one graphical indicia coupled to said front surface.

10. An exercise equipment protective covering system as recited in claim 7, wherein said at least one retention strap comprises a fastener coupled to said second end.

11. An exercise equipment protective covering system as recited in claim 10, wherein said fastener is a hook and loop fastener.

12. An exercise equipment protective covering system as recited in claim 7, further comprising at least one accessory pocket coupled to said exercise equipment protective cover, wherein said at least one accessory pocket provides an outwardly accessible storage region for personal items.

* * * * *